US006688002B2

(12) United States Patent
Momose et al.

(10) Patent No.: US 6,688,002 B2
(45) Date of Patent: Feb. 10, 2004

(54) ELECTRIC SHAVER

(75) Inventors: Kazuhiro Momose, Matsumoto (JP); Akira Hirabayashi, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 09/897,510

(22) Filed: Jun. 29, 2001

(65) Prior Publication Data

US 2002/0007557 A1 Jan. 24, 2002

(30) Foreign Application Priority Data

Jun. 30, 2000 (JP) ..... 2000-197433

(51) Int. Cl.[7] ..... B26B 19/28

(52) U.S. Cl. ..... 30/43.92; 30/346.51

(58) Field of Search ..... 30/43.92, 43.91, 30/346.51, 223, 43.6, 43.5, 43.3, 43.8, 43, 43.9

(56) References Cited

U.S. PATENT DOCUMENTS

| | | | | |
|---|---|---|---|---|
| 2,177,440 A | * | 10/1939 | Muros | 30/43.92 |
| 6,357,117 B1 | * | 3/2002 | Eichorn et al. | 30/43.92 |

FOREIGN PATENT DOCUMENTS

| | | |
|---|---|---|
| EP | 0 721 824 | 7/1996 |
| GB | 1 251 289 | 10/1971 |
| JP | H6-126043 | 5/1994 |
| JP | 10-151282 | 6/1998 |

* cited by examiner

*Primary Examiner*—Douglas D. Watts
(74) *Attorney, Agent, or Firm*—Koda & Androlia

(57) ABSTRACT

An electric shaver comprising a main body case which contains an electric motor, and a cutter head section which contains an outer cutter and an inner cutter and is attached to an upper portion of the main body case, in which the shaver further includes a supporting member that has a supporting plate body and leg portions and is provided on an upper portion of the main body case via the leg portions that has elasticity and disposed on both ends of the supporting plate body, and the cutter head section is provided on the supporting plate body.

6 Claims, 5 Drawing Sheets

ELECTRIC SHAVER

BACKGROUND OF THE INVENTION

1. Field of the Invention

The present invention relates to an electric shaver and more particularly to an improved cutter head section in an electric shaver.

2. Prior Art

Electric shavers are generally constructed from a main body case and a cutter head section. The main body case is held in hand during shaving, and it contains an electric motor, a power supply switch and a power supply that supplies power to the electric motor. The cutter head section is mounted on the upper portion of the main body case, and it contains an outer cutter and inner cutter.

In recent electric shavers, the cutter head sections are designed so as to pivot. In other words, the cutter head section pivots with respect to the main body case in accordance with the shape of the face (thus so-called "swinging of the head") when the main body case is held in hand and the electric shaver is moved with the outer cutter pressed against the skin. As a result, the outer cutter can be held in tight contact with the skin for a longer period of time to cut hair more efficiently. Such electric shavers have been put on the market Such a swinging-head structure is generally realized by attaching the cutter head section to the upper portion of the main body case so that the cutter head section can pivot through a specified angle about a single predetermined axial line. In one example, this axial line is set parallel to the direction of width of the main body case as disclosed in Japanese Patent Application Laid-Open (Kokai) No. H6-126043.

However, in the above head-swinging structure, the pivoting direction of the cutter head section with respect to the main body case is fixed. As a result, the outer cutter cannot always be caused to make a snug contact with the skin when the cutter head section is merely moved while the electric shaver is being moved along the surface of the face. This is because the face surface is uneven, and there are variations in shape. Accordingly, the user needs to incline the main body case, which is held in hand, in order to achieve an appropriate match with the contour of the skin. Thus, the conventional electric shavers are not quite convenient for actual use.

SUMMARY OF THE INVENTION

Accordingly, the object of the present invention is to solve the above-described problems.

More specifically, the object of the present invention is to provide an electric shaver in which a cutter head section can be moved in all directions with respect to the main body case of the electric shaver upon receipt of an external force from the skin Furthermore, the object of the present invention is to provide an electric shaver in which the outer cutter is able to make a snug contact with the skin surfaces of the face hat has a varying contour during shaving.

The above-described objects are accomplished by a unique structure for an electric shaver that comprises: a main body case which contains an electric motor, and a cutter head section which contains an outer cutter and an inner cutter and is provided on an upper portion of the main body case, and the unique structure of the present invention is that a supporting member which is comprised of a supporting plate body and leg portions is provided in an upper portion of the main body case via the leg portions that consist of elastic material disposed on both ends of the supporting plate body, and the cutter head section is mounted on the thus provided supporting plate body of the supporting member.

In the above unique structure, the cutter head section is fastened to the supporting member, and this supporting member is installed in the upper portion of the main body case via elastic leg portions.

Accordingly, when, upon use of the shaver, the cutter head section contacts the skin and receives an external force from the skin, the leg portions undergo elastic deformation in accordance with the magnitude and direction of the external force. As a result, the cutter head section, more specifically the outer cutter that is inside the cutter head section and contacts directly with the skin, is moved all directions with respect to the main body case. In other words, the outer cutter makes a swivel motion without any specified fulcrum or specified axial line and makes a constant snug contact with the skin.

When the cutter head section is removed from the skin, the elastically deformed leg portions return to their original shape, and as a result the cutter head section also returns to its initial position with respect to the main body case.

In the above electric shaver, the supporting member is constructed from a plate spring in which both ends thereof are bent in the same direction to form the leg portions, and a plateform portion located between the leg portions is used as the supporting plate body. Thus, the structure of the supporting member is simple, and the number of components required is small. Also, the cost of the shaver can be reduced.

Furthermore, in the electric shaver of the present invention, the inner cutter is provided so as to perform a reciprocating motion with respect to the outer cutter. In this case, it is preferable to provide, inside the cutter head section, a conversion mechanism that converts the rotational motion of the output shaft of the electric motor into a linear motion that causes the inner cutter to perform the reciprocating motion.

With this structure, the leg portions made from elastic material is interposed between the conversion mechanism, which converts the rotational motion into a linear motion and generates the greatest vibration, and the main body case that is held in hand during the use of the shaver. Accordingly, the vibration generated by the conversion mechanism is absorbed by the leg portions, and the vibration transmitted to the main body case is reduced. Unpleasant vibrations to the user are thus avoided, and the convenience of use is improved.

Furthermore, a coil spring is mounted on an output shaft of the electric motor so that the rotational motion of the output shaft is transmitted to the interior of the cutter head section via the coil spring. With this structure, the rotational motion is reliably transmitted to the cutter head section or to the inner cutter while the coil spring deforms in accordance with the deformation of the leg portion of the supporting member. Moreover, the cost of parts is greatly reduced compared to the structure that uses an expandable universal joint. Also, since the structure is simple, malfunction of the shaver can be expected to be less.

Furthermore, in the above electric shaver of the present invention, locking assemblies are provided in the main body case. The locking assemblies are set at a deformation-restricting position in which the locking assemblies contact the undersurface of the supporting plate body and restrain an elastic deformation of the leg portions and at a deformation-permitting position in which the locking assemblies are separated from the undersurface of the supporting plate body and permit the elastic deformation of the leg portions. More specifically, each the locking assembly is provided with a supporting element, and one end of the supporting element is pivotally provided so that the other end is movable in a circular arc.

With this structure, it is possible to regulate the movement of the cutter head section with respect to the main body case. Hair can be thus shaved with the cutter head section pressed firmly against the skin while the user tilts and moves the main body case in accordance with the contour of the skin. It is, accordingly, possible for the user to shave with his desired angle.

DETAILED DESCRIPTION OF THE INVENTION

Figure 1:
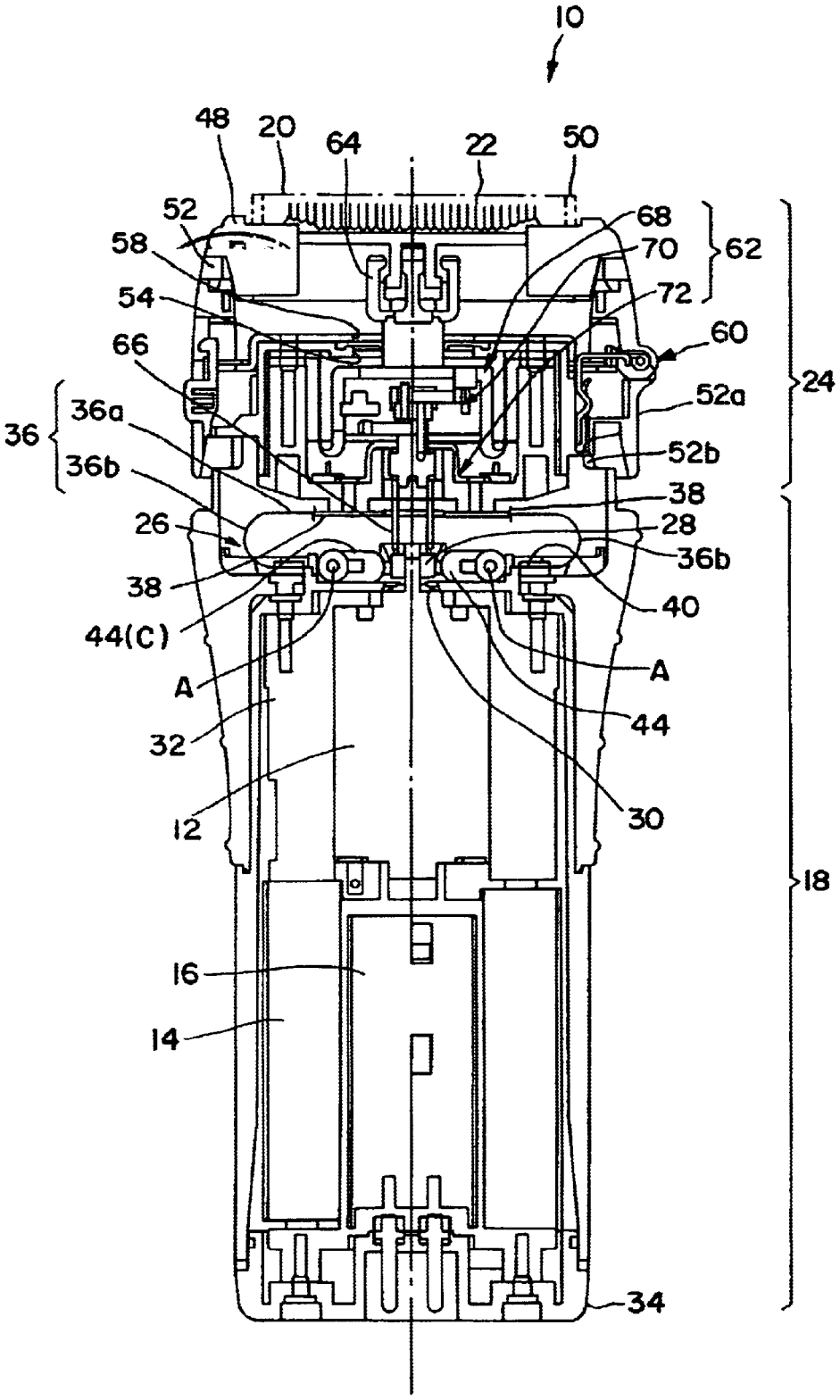
FIG. 1 is a sectional view of the structure of one embodiment of the electric shaver according to the present invention.

Preferred embodiments of the electric shaver of the present invention will be described in detail below with reference to the accompanying drawings. The invention will be described with reference to a reciprocating electric shaver.

First, the construction of the electric shaver will be described with reference to FIGS. 1 through 4.

The reciprocating electric shaver 10 is essentially comprised of a main body case 18 and a cutter head section 24. Inside the main body case 18 is provided an electric motor 12 and a power supply (battery 14 and AC/DC converter 16) that supplies power to the electric motor 12, etc. The cutter head section 24 is mounted on the upper portion of the main body case 18. The cutter head section 24 contains an outer cutter 20 and an inner cutter 22 that performs a reciprocating motion with respect to the outer cutter 20.

The main body case 18 is formed as a tubular body and is designed externally so as to be easily held in hand of the user (the cross section of the main body case 18 being in, for instance, an oval shape, a rectangular shape with rounded corners, etc.). In the upper portion of the main body case 18 is formed an accommodating recess section 26 in which the supporting member (described later) and other parts are accommodated. A first through-hole 30 through which the output shaft 28 of an electric motor 12 is passed is formed in the center of the inside bottom of the accommodating recess section 26.

An inner case 32 is attached to the interior of the main body case 18, and an electric motor 12 and battery 14 are installed in this inner case 32. When an AC/DC converter 16 is employed, the converter 16 can be installed in the inner case 32.

The battery 14 is mounted in the inner case 32 and removed from the inner case 32 by way of attaching and detaching a main body lower case 34 which is detachably attached to the lower opening portion of the main body case 18.

The output shaft 28 of the electric motor 12 is passed through the first through-hole when the inner case 32 is installed in a specified position inside the main body case 18. The tip end of the output shaft 28 protrudes into the accommodating recess section 26.

Furthermore, a supporting member 36 is attached to the inside bottom surface of the accommodating recess section 26 of the main body case 18 so that the supporting member 36 covers the fist through-hole 30.

More specifically, the supporting member 36 has a supporting plate body 36*a* and a pair of leg portions 36*b*. The leg portions 36*b* are made of elastic material and are disposed on both ends of the supporting plate body 36*a*. The lower ends of the respective leg portions 36*b* are fastened to the inside bottom surface of the accommodating recess section 26 so that the first through-hole 30 is positioned between the respective leg portions 36*b*. The supporting member 36 is thus provided on the upper portion of the main body case.

In the shown embodiment, the supporting member 36 is constructed using a plate spring. Both ends of this plate spring are bent in the same direction (i.e., toward the same side of the plate spring) into a cross-sectional U shape (a cross-sectional C shape, L shape, horizontal V shape, horizontal W shape, etc. may also be used) so as to form the leg portions 36*b*. The plate-form (flat) portion located between the leg portions 36*b* constitutes the supporting plate body 36*a*.

The supporting plate body 36*a* and the leg portions 36*b* can be separately formed. In this case, these parts are connected to each other to form the supporting member 36. However, forming the supporting member 36 by working a single plate spring as in the shown embodiment results in a reduction in the number of parts required. Also, such a supporting member 36 can be manufactured easily with a sufficient durability. In cases where the supporting plate body 36*a* and leg portions 36*b* are formed separately, the leg portions 36*b* can be constructed from various types of elastic members. In other words, the leg portions 36*b* can be formed of spring members such as coil springs, plate springs, etc. Further, the leg portions 36*b* can be formed into masses such as columnar bodies, etc. using rubber.

Furthermore, the cutter head section 24 is mounted on the supporting plate body 36*a* of the supporting member 36. Thus, so as to increase the rigidity of the supporting plate body 36*a* and keep its planar shape, first auxiliary plates 38 are tightly attached to the top surface and undersurface of the plate-form portion of the plate spring that constitutes the supporting plate body 36*a*. Furthermore, second auxiliary plates 40 are also installed on both end edges of the plate spring that constitute the respective leg portions 36*b* for the same reason as the above-described auxiliary plates 38.

When a sufficient rigidity is obtained using a plate spring alone, the first auxiliary plates 38 and second auxiliary plates 40 can be omitted.

With the structure described above, the supporting plate body 36*a* is supported by the leg portions 36*b* so that the supporting plate body 36*a* is positioned in a more or less parallel attitude above the first through-hole 30 that is located above the inside bottom surface of the accommodating recess section 26 with a space in between. When an external force is applied to the supporting plate body 36*a*, a force with a magnitude corresponding to the magnitude of such an external force acts in a direction corresponding to the direction of the external force on the respective leg portions 36*b* via the supporting plate body 36*a*. Thus, the respective leg portions 36*b* that has elasticity can undergo deformation independently of each other; and the supporting plate body 36*a* freely moves in all directions (by tilting, sinking, twisting and pivoting) inside the accommodating recess section 26. When the external force is removed, the respective leg portions 36*b* return to their original positions as a result of their own elastic force; and the supporting plate body 36*a* also returns to its initial position.

In the above structure, it is necessary to transmit the rotation of the output shaft 28 of the electric motor 12 that protrudes from the first through-hole 30 positioned beneath the supporting member 36 to the cutter head section 24 which is provided on the supporting member 36 in such a manner to move in all directions. For this purpose, a second through-hole 42 through which a coil spring (described later) is passed is formed in the supporting member 36. In other words, the second through-hole 42 is formed in the supporting plate body 36*a* of the supporting member 36.

Furthermore, a pair of locking assemblies 44 are disposed on the inside bottom surface of the accommodating recess section 26 so that each locking assembly 44 is on either side of the first through-hole 30. The locking assembly 44 is substantially comprised of two supporting elements 44*a*, a shaft 44*b*, and an operating element 44*c*. The locking assemblies 44 are disposed so as to be surrounded by the leg portions 36*b* of the supporting member 36 and so as to be pivotable about axial lines A that extend in the direction of the thickness of the main body case 18.

More specifically, the locking assemblies 44 are provided so as to be set at a deformation-restricting position B and at a deformation-permitting position C.

Figure 5:
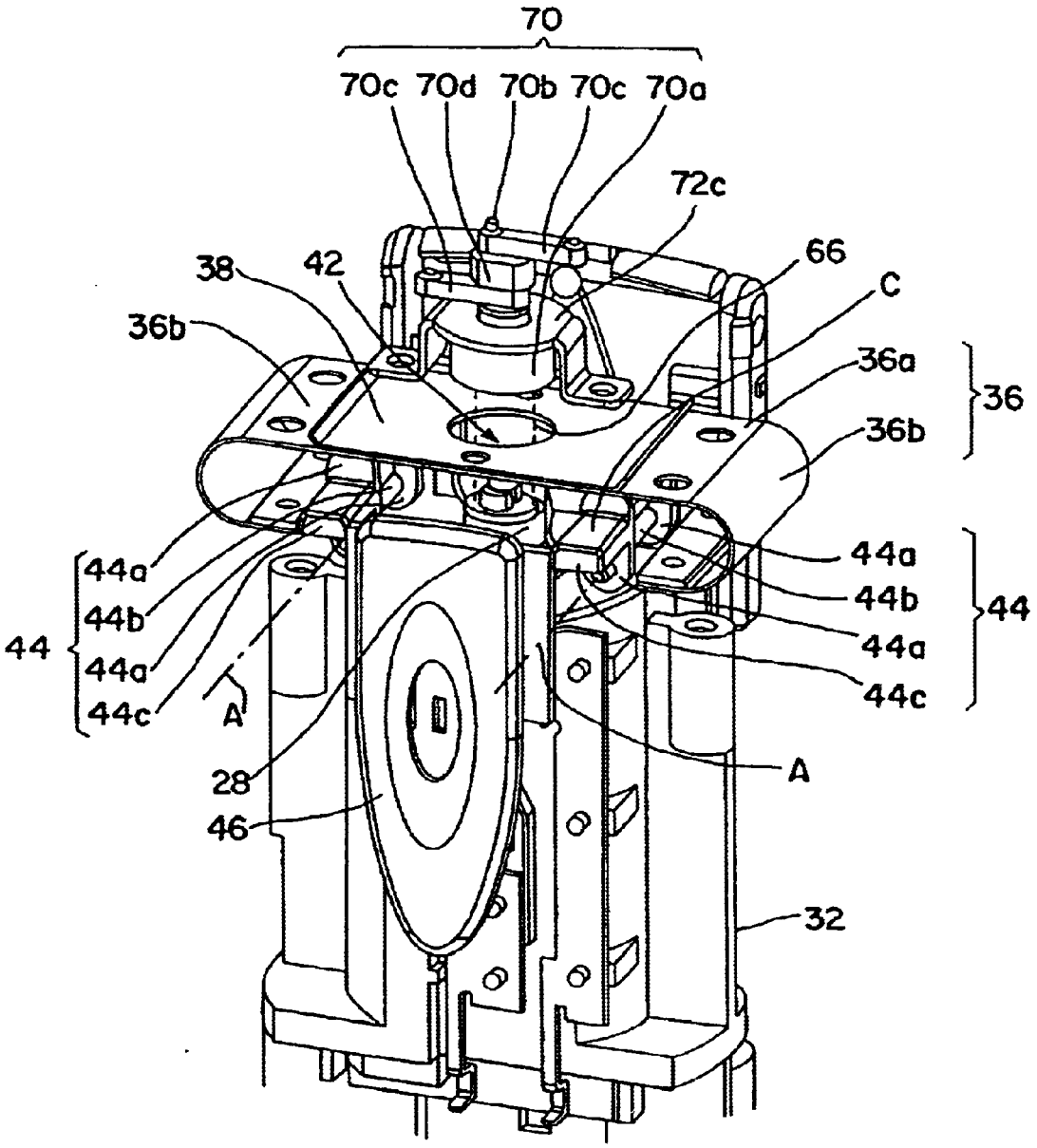
FIG. 5 is an explanatory diagram mainly showing the structure of the locking assemblies used in the shaver of the present invention, the locking assemblies being in the deformation-restricting position.

At the deformation-restricting position B, the upper ends of the locking assemblies 44 (more specifically the upper ends of the supporting elements 44*a* that will be described below) contact the undersurface of the supporting plate body 36*a*, thus restricting the elastic deformation of the leg portions 36*b* and restricting the movement of the supporting plate body 36*a* even if an external force is applied to the supporting plate body 36*a*. In other words, the deformation-restricting position B is the position in which the locking assemblies 44 are raised into an upright attitude from the inside bottom surface of the accommodating recess section 26 as shown in FIG. 5.

Figure 3:
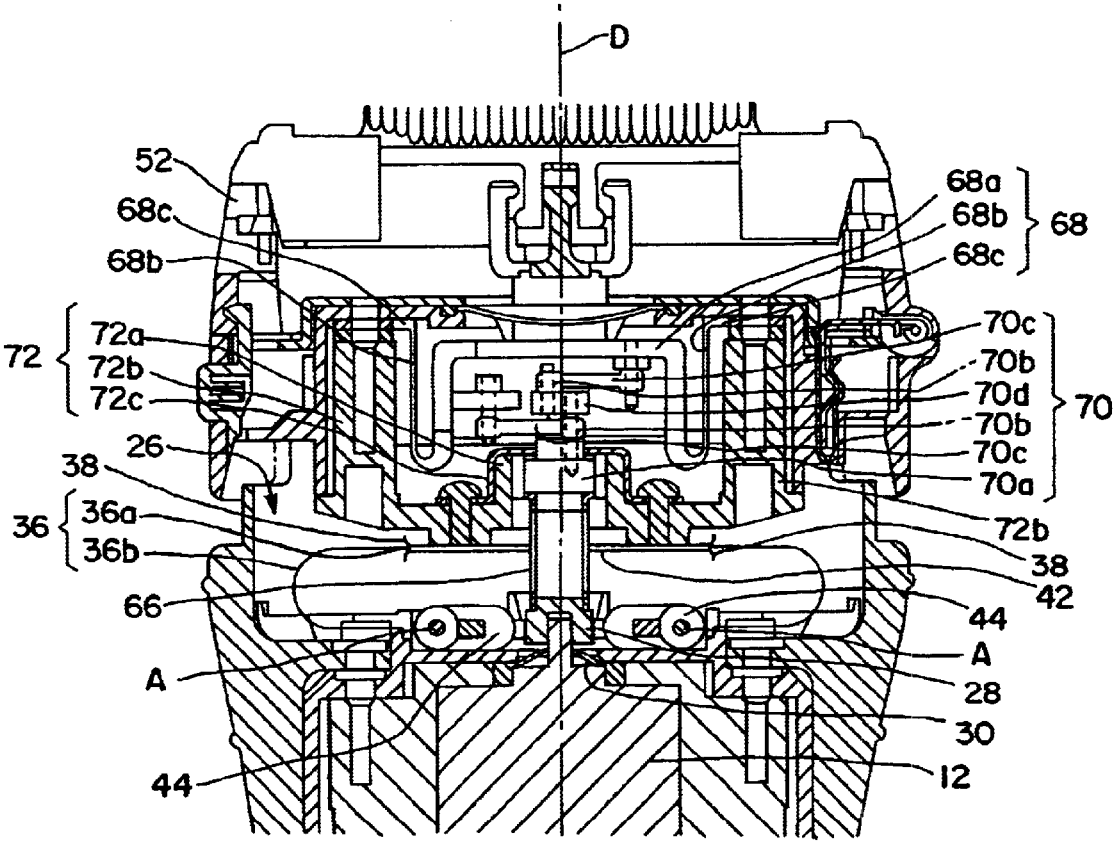
FIG. 3 is an enlarged view showing the essential portion of the structure of the connecting parts of the cutter head section and main body case in FIG. 1.
Figure 4:
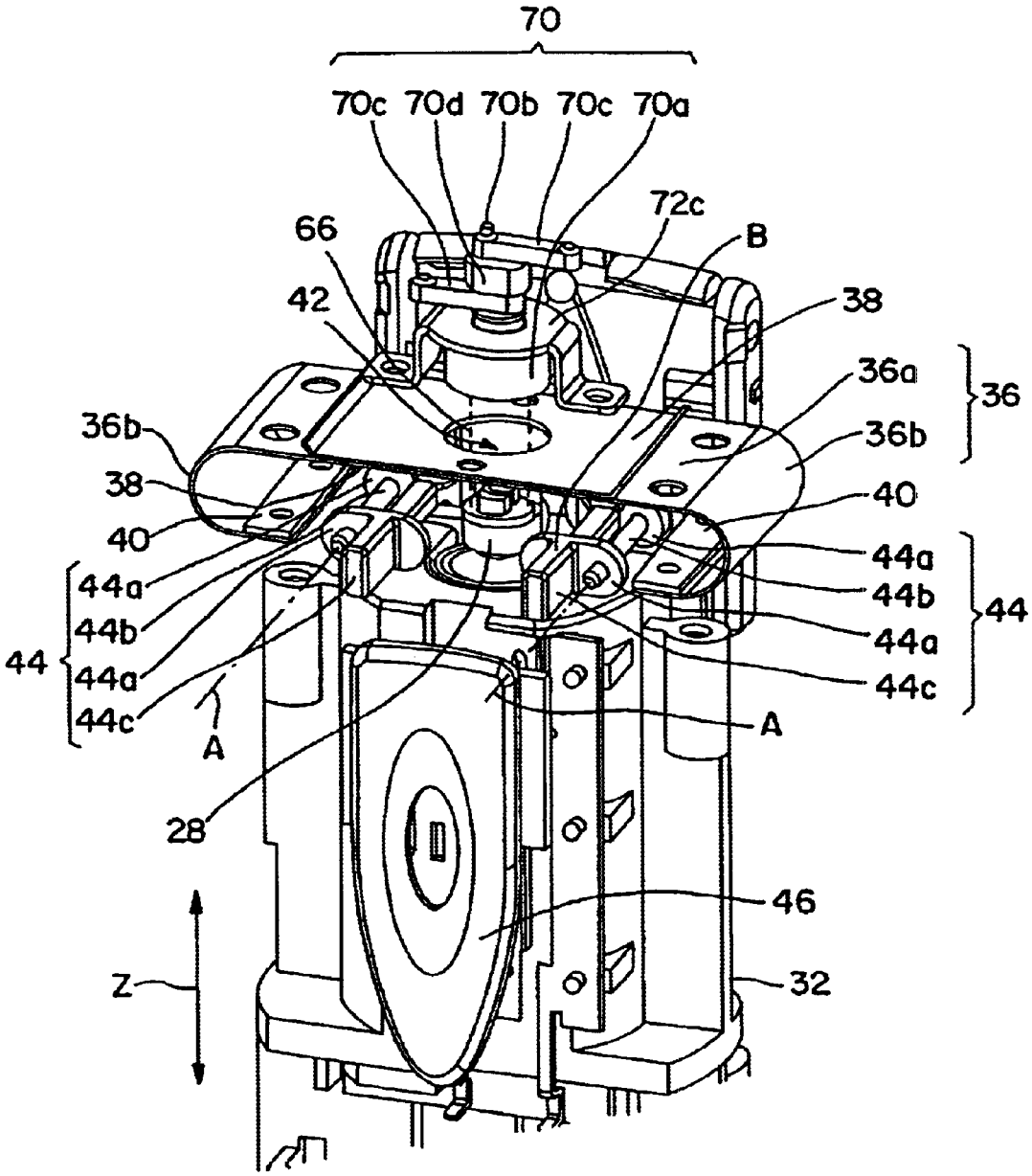
FIG. 4 is an explanatory diagram mainly showing the structure of a pair of locking assemblies used in the shaver of the present invention, the locking assemblies being in the deformation-permitting position.

At the deformation-permitting position C, the locking assemblies 44 rotate toward the first through-hole 30, so that the tip ends of the locking assemblies 44 (more specifically the upper ends of the supporting elements 44*a*) are separated from the undersurface of the supporting plate body 36*a*, thus permitting the leg portions 36*b* to make an elastic deformation. In other words, the deformation-permitting position C is the position in which the locking assemblies 44 lie flat above the inside bottom surface of the accommodating recess section 26 as shown in FIGS. 1, 3 and 4.

Figure 2:
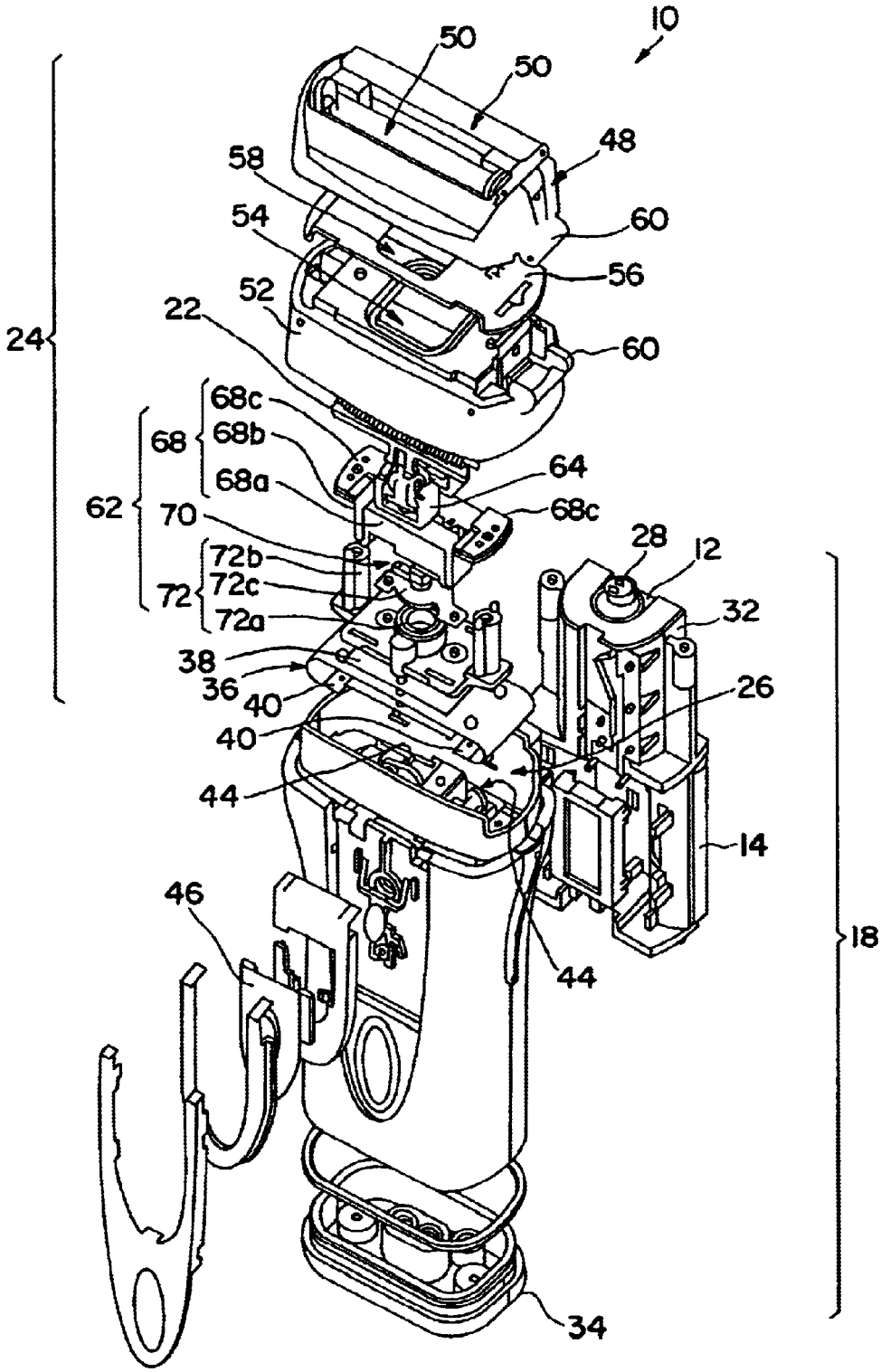
FIG. 2 is an exploded perspective view of the structure of one embodiment of the electric shaver of the present invention.

In FIG. 2, the locking assemblies 44 are oriented in respectively different positions. However, these positions are shown only for the purpose of convenience of description. Both locking assemblies 44 are ordinarily positioned in the same position.

Each locking assembly 44 has two supporting elements 44*a*, so that a total of four supporting elements 44*a* are respectively disposed beneath the four corners of the supporting plate body 36*a*. One end of each supporting element 44*a* of each locking assembly 44 is pivotally provided so that another end of the supporting element 44*a* is moved along a circular arc. Such one end of the supporting element 44*a* can be provided by a dovetail engagement on the case body 18. Instead, the supporting element 44*a* can be disposed on a shaft. The supporting element 44*a* is, for instance, rectangle in external shape with its shorter sides rounded.

More specifically, the supporting elements 44*a* of each locking assembly 44 are provided at either end of the shaft 44*b* that are disposed on an axial line A so that the supporting elements 44*a* can pivot around the shaft 44*b*. The supporting elements 44*a* are pivoted in linkage with each other so that the two supporting elements 44*a* always have the same rotational angle with respect to the inside bottom surface of the accommodating recess section 26. A driving means (e.g., a torsion coil spring, etc.; not shown) which constantly urges the supporting elements 44*a* in the direction that causes the supporting elements 44*a* to lie flat on the inside bottom surface of the accommodating recess section 26 is installed on each locking assembly 44.

The supporting elements 44*a* of each locking assembly 44 can be formed in a single long columnar element that has the same cross-sectional shape from one end to the other. With this structure, edge areas of the supporting plate body 36*a* in the direction parallel to the leg portions 36*b* are supported in their entirety by the locking assemblies 44. Thus, the support for the supporting plate body 36*a* is stabilized.

The supporting elements 44*a* are not limited to the shape described above. The supporting elements 44*a* may have a non-circular shape cross-sectional. In this case, one end of each supporting element 44*a* is pivotally attached to the main body case 18 (via a shaft, for instance) so that the other end of the supporting element 44*a* moves in a circular arc. Furthermore, the cross-sectional shape of the supporting elements 44*a* can be circular. In this case, substantially the same function can be fulfilled by pivotally attaching each supporting element 44*a* to the main body case 18 at an eccentric position thereof.

Furthermore, operating elements 44*c* are provided on the supporting elements 44*a* so as to be located on the same side in the direction of the axial line A. The operating elements 44*c* are disposed so as to protrude from the surface of the main body case 18. A locking button 46 is disposed on the surface of the main body case 18 on the side from which the operating elements 44*c* protrude. The locking button 46 is disposed so as to slide in the direction of the length of the main body case 18, the direction shown by arrow Z in FIG. 4.

With the above structure, when the locking button 46 is caused to slide toward the operating elements 44*c* (thus being slid upward), the operating elements 44*c* are pushed upward toward the upper portion of the main body case 18. As a result, the supporting elements 44*a* of the locking assemblies 44 pivot about the shafts 44*b* against the driving force of the driving means (spring). Thus, the supporting elements 44*a* are moved from the deformation-permitting position C shown in FIG. 4 in which the supporting elements 44*a* of the locking assemblies 44 lie flat on the inside bottom surface of the accommodating recess section 26 to the deformation-restricting position B shown in FIG. 5 in which the supporting elements 44*a* stand upright on the inside bottom surface of the accommodating recess section 26.

In the deformation-restricting position B, the tip (upper) ends of the supporting elements 44*a* of the respective locking assemblies 44 contact the undersurfaces of the supporting plate body 36*a*, and the four corners of the supporting plate body 36*a* are supported by the supporting elements 44*a*. Accordingly, the movement of the supporting plate body 36*a* is restricted. When the locking button 46 is caused to slide in the opposite direction from the operating elements 44*c* (thus being slid downward), the supporting elements 44*a* of the respective locking assemblies 44 are caused to pivot by the driving force of the driving means in the direction that causes the supporting elements 44*a* to lie flat. As a result, the supporting elements 44*a* automatically return to the deformation-permitting position C shown in FIG. 4.

In an outer cutter frame stand 48, for instance, two outer cutter holders 50 are installed side by side. Each outer cutter holder 50 is provided so as to move independently in the vertical direction (or toward the main body case 18) by a specified amount. Furthermore, outer cutter 20 is respectively attached to the respective outer cutter holders 50.

The cutter frame attachment stand 52 is formed in the shape of an inverted cup which fits over the upper portion (accommodating recess section 26) of the main body case 18. The lower part of the cutter frame attachment stand 52 is formed with a double wall structure, having the outer wall 52*a* and the outer wall 52*b*. The inner circumferential shape of the outer wall 52*a* of the cutter frame attachment stand 52 is similar to the outer circumferential shape of the tubular wall of the accommodating recess section 26 and is formed so as to be slightly larger than the tubular wall surface. On the other hand, the outer circumferential shape of the inner wall 52*b* of the cutter frame attachment stand 52 is similar to the inner circumferential shape of the tubular wall of the accommodating recess section 26 and is formed so as to be slightly smaller than the tubular wall.

As a result, the cutter frame attachment stand 52 is fitted over the upper portion of the main body case 18 in a labyrinth structure in which the tubular wall surface of the accommodating recess section 26 is inserted into the ring-form space formed between the outer wall 52*a* and inner wall 52*b* of the cutter frame attachment stand 52. The width of the space formed by the outer wall 52*a* and inner wall 52*b* is set so that the cutter frame attachment stand 52 and accommodating recess section 26 do not interfere with each other even if the cutter frame attachment stand 52, i.e., the cutter head section 24, is moved to some extent.

The cutter frame attachment stand 52 is formed with a third through-hole 54 so as to open in the center of the upper wall thereof.

A fulcrum plate spring 56 is attached to the upper surface of the upper wall surface of the cutter frame attachment stand 52, and a fourth through-hole 58 is opened in this fulcrum plate spring 56 in a position corresponding to the third through-hole 54. The fulcrum plate spring 56 functions so that the outer cutter holders 50 attached to the outer cutter frame stand 48 are constantly driven upward with respect to the outer cutter frame holder 48 and so that even in cases where the outer cutter holders 50 are pushed into the outer cutter frame stand 48 by an external force, the outer cutter holders 50 will return to their original positions when this external force is eliminated.

The outer cutter frame stand 48 is attached to the cutter frame attachment stand 52 via the connecting part 60 of a hinge structure so that the outer cutter frame stand 48 is free to open and close.

An oscillating mechanism 62 is installed inside the cutter frame attachment stand 52. The oscillating mechanism 62 converts the rotational motion of the output shaft 28 of the electric motor 12 into a linear reciprocating motion, thus causing the inner cutter 22 to perform a reciprocating motion.

This oscillating mechanism 62 is inserted into the interior of the cutter frame attachment stand 52 from beneath the cutter frame attachment stand 52 and is fastened to the upper wall of the cutter frame attachment stand 52. In this state, an inner cutter connecting part 64 which extends from the upper part of the oscillating mechanism 62 passes through both the third through-hole 54 formed in the cutter frame attachment stand 52 and the fourth through-hole 58 formed in the fulcrum plate spring 56, thus protruding from the cutter frame attachment stand 52.

The inner cutter 22 is attached to this inner cutter connecting part 64.

The output shaft 28 of the electric motor 12 and the oscillating mechanism 62 are connected by a coil spring 66 that is disposed so that it passes through the second through-hole 42 formed in the supporting plate body 36*a*. In this way, the rotational motion of the output shaft 28 is transmitted to the oscillating mechanism 62. The reason that a coil spring 66 is used is as follows: in the electric shaver 10 of this embodiment, the cutter head section 24 receives an external force from the skin and freely move with respect to the main body case 18; accordingly, it is necessary for the cutter head section 24 to be able to bend, retract, extend and turn with respect to the main body case 18 in accordance with this movement.

The structure of the oscillating mechanism 62 itself is the same as that of the conventional mechanism. Accordingly, in the following, a detailed description of the oscillating mechanism 62 will be omitted.

The oscillator 68 is comprised of a moving stand 68*a* to which the inner cutter connecting part 64 is attached, a pair of U-shape bodies 68*b* which are installed on both sides of the moving stand 68*a*, and a pair of fastening stands 68*c* which support the moving stand 68*a* via the pair of U-shaped bodies 68*b* so that the moving stand 68*a* can perform a linear reciprocating motion.

The conversion mechanism 70 installed beneath the oscillator 68 has the function of converting a rotational motion into a linear reciprocating motion. This mechanism is comprised of: a rotating disk 70*a* which is rotatably connected to the output shaft 28 of the electric motor 12 by the coil spring 66, two pins 70*b* which are installed in an upright attitude in positions that are eccentric with respect to the rotational axis D of the rotating disk 70*a*, and two links 70*c* which are connected at one ends thereof to the respective pins 70*b*. The other ends of the links 70*c* are connected to the moving stand 68*a* or U-shaped bodies 68*b*. Furthermore, of the two pins 70*b*, the lower pin 70*b* is installed in an upright attitude on the rotating disk 70*a*, while the upper pin 70*b* is installed in an upright attitude on another disk-form body 70*d* that is attached to the lower pin 70*b*.

The oscillating base 72 is installed beneath the conversion mechanism 70 and has a guide tube 72*a* and a pair of supporting columns 72*b*. The guide tube 72*a* guides the rotating disk 70*a* so that the rotating disk 70*a* is rotatable about its axial line D. The supporting columns 72*b* are disposed so as to protrude on either side of the guide tube 72*a*. The spacing of the supporting columns 72*b* is set so that it is wider than the spacing of the pair of U-shaped bodies 68*b* of the oscillator 68. The upper end surfaces of the supporting columns 72*b* are screw-fastened to the upper wall surface of the cutter frame attachment stand 52 so that they clamp the fastening stands 68*c* of the oscillator 68, thus connecting the cutter frame attachment stand 52, oscillator 68 and oscillating base into an integral unit.

Furthermore, the oscillating base 72 is fastened to the supporting member 36, so that the cutter head section 24 as a whole is attached to the supporting member 36.

The rotating disk 70*a* disposed inside the guide tube 72*a* is connected to the output shaft 28 by means of the coil spring 66 and is constantly driven upward by the driving force of the coil spring 66. Accordingly, a fastening fitting 72*c* which closes off the opening part of the guide tube 72*a* in a state in which only the central area of the rotating disk 70*a* on which the pins 70*b* are installed in an upright attitude is exposed is attached to the guide tube 72*a* by means of screws so that the rotating disk 70*a* is prevented from slipping out from the upper end of the guide tube 72*a*.

Next, the operation of the electric shaver 10 that has the above-described structures of the cutter head section 24 and main body case 18 will be described.

When whiskers are to be shaved with the electric shaver 10, the main body case 18 is held in hand, and the outer cutter 20 of the cutter head section 24 is placed against the skin. In this case, the outer cutter 20 first moves while sinking into the interior of the outer cutter frame holder 48 against the elastic force (driving force) of the fulcrum plate spring 56, or appropriately tilting, etc., in accordance with variations in the contour of the skin, so that the outer cutter 20 can be maintained in a tightly adhering state against the skin.

In cases where there are variations in the contour of the skin that cannot be absorbed by the movement of the outer cutter 20 alone, i.e., in cases where the outer cutter 20 has moved to the deepest part of the outer cutter frame stand 48 and cannot move any further, the external force from the skin causes the cutter head section 24 itself to perform movements such as tilting and sinking, etc., as a result of the elastic deformation of the leg portions 36*b* of the supporting member 36, so that the outer cutter 20 is maintained in tight contact with the skin.

Ordinarily, the elastic force of the leg portions 36*b* that support the cutter head section 24 is set so that it is considerably greater than the elastic force of the fulcrum plate spring 56 that drives the outer cutter 20. Accordingly, the outer cutter 20 is moved first, followed by the cutter head section 24 as described above. Thus, if the difference between the elastic force of the leg portions 36*b* and the elastic force of the fulcrum plate spring 56 is small, the cutter head section 24 would be moved slightly together with the movement of the outer cutter 20.

For users who desire the cutter head section 24 not to be moved, the locking button 46 is used. The locking button 46 is caused to slide so that the locking assemblies 44 are shifted from the state shown in FIG. 4 to the state shown in FIG. 5. As a result, the supporting plate body 36*a* of the supporting member 36 is supported from underneath by the locking assemblies 44. Thus, even if an external force is applied to the cutter head section 24, the elastic deformation of the leg portions 36*b* is restricted, and the movement of the cutter head section 24 is restricted.

In the above-described electric shaver, the oscillating mechanism 62 that generates the largest vibration when it changes rotational motion into linear reciprocating motion is installed inside the cutter head section 24, which is connected to the main body case 18 via the elastically deformable leg portions 36*b*. Thus, inside the main body case 18 that is actually held in hand of a user is installed only the electric motor 12 that performs only a rotational motion which generates a small vibration compared to the oscillating mechanism 62. Accordingly, the vibration generated by the oscillating mechanism 62 is absorbed by the leg portions 36*b* and is therefore not transmitted to the main body case 18. Unpleasant vibrations that are transmitted to the hand are reduced, thus improving the convenience to the user.

The above embodiment is described with reference to a reciprocating type electric shaver. However, the structure of the present invention, in which the electric shaver is divided into a cutter head section and a main body case that is held in hand of the user, and such two parts are connected by an elastically deformable member such as the supporting member, can be applied to a rotary type electric shaver.

As seem from the above, in the electric shaver of the present invention, the cutter head section is provided on a supporting plate body that is attached to the upper portion of the main body case via leg portions that has elasticity. Accordingly, when the cutter head section contacts the skin and receives an external force from the skin, the leg portions undergo elastic deformation in accordance with the magnitude and direction of such an external force. As a result, the cutter head section, more specifically, the outer cutter that contacts the skin directly and is provided inside the cutter head section, performs truly three-dimensional movements without any specified fulcrum or specified axial line relative to the main body case, and the outer cutter is constantly able to be in contact with the skin. Accordingly, it is not always necessary for users to move the main body case of the shaver in accordance with variations in the contour of the skin, and the convenience of use of the shaver is improved.

What is claimed is:

1. An electric shaver comprising a main body case that contains an electric motor and a cutter head section that contains an outer cutter and an inner cutter and is provided on said main body case, said electric shaver further comprising:

a supporting member which is comprised of a supporting plate body and leg portions and is provided in said main body case via said leg portions, said leg portions having elasticity and disposed on both cads of said supporting plate body, and wherein said cutter head section is mounted on said supporting plate body; and said cutter head section is movable in all directions: whereby said cutter head section makes snug contact with skin surfaces of a face of a user.

2. An electric shaver comprising a main body case that contains an electrical motor and a cutter bead section that contains an outer cutter an inner cutter and is provided on said main body case, said electric shaver further comprising:

a supporting member which is comprised of a supporting plate body and leg portions and is provided in said main body case via said leg portions, said leg portions having elasticity and disposed on both ends of said supporting plate body, and wherein said cutter head section is mounted on said supporting plate body; and said supporting member is formed from a plate spring with both ends thereof being bent in the same direction so as to form said leg portions, said supporting plate body being formed by a plate-form portion located between said leg portions.

3. The electric shaver according to claim 1, wherein:

said inner cutter performs a reciprocating motion with respect to said outer cutter, and a conversion mechanism is provided inside said cutter head section, said conversion mechanism converting a rotational motion of an output shaft of said electric motor into a linear motion that causes said inner cutter to perform said reciprocating motion.

4. An electric shaver comprising a main body case that contains an electric motor and a cutter head section that contains an outer cutter and an inner cutter and is provided on said main body case, said electric shaver further comprising:

a supporting member which is comprised of a supporting plate body and leg portions and is provided in said main body case via said leg portions, said leg portions having elasticity and disposed on both ends of said supporting plate body, and wherein said cutter head section is mounted on said supporting plate body; and a coil spring is mounted on an output shalt of said electric motor so that a rotational motion of said output shaft is transmitted to mi interior of said cutter head section via said coil spring.

5. An electric shaver comprising a main body case that contains an electric motor mid a cutter head section that contains an outer cutter and an inner cutter and is provided on said main body case, said electric shaver further comprising:

a supporting member which is comprised of a supporting plate body and leg portions and is provided in said main body case via said leg portions, said leg portions having elasticity and disposed on both ends of said supporting plate body, and wherein said cutter head section is mounted on said supporting plate body; and further comprising a locking assembly provided in said main body case, said locking assembly being set at a deformation-deformation-restricting position in which said locking assembly contacts an undersurface of said supporting plate body and restrains an elastic deformation of said leg portions and being set at a deformation-permitting position in which said locking assembly is separated from said undersurface of said supporting plate body and permit said elastic deformation of said leg portions.

6. The electric shaver according to claim 5, wherein said locking assembly includes supporting elements, one end of said supporting elements being pivotally attached to said main body case and another end of each one of said looking assemblies being movable in a circular arc.

* * * * *